United States Patent [19]

Ashby et al.

[11] Patent Number: 4,938,507

[45] Date of Patent: Jul. 3, 1990

[54] BUSINESS FORM WITH REPOSITIONABLE LABELS

[75] Inventors: Robert E. Ashby, Quakertown, Pa.; Wlater G. Greig, Lewiston, N.Y.

[73] Assignee: Moore Business Forms, Inc., Grand Island, N.Y.

[21] Appl. No.: 230,033

[22] Filed: Aug. 9, 1988

[51] Int. Cl.[5] ..... B41L 1/26

[52] U.S. Cl. ..... 282/9 R; 282/1 R; 283/1 R

[58] Field of Search ..... 283/81; 282/8 A, 8 R, 282/9 R, 11.5 A, 11.5 R, 21 R, 23 R, 27 R, 28 A, 28 R, 1 R

[56] References Cited

U.S. PATENT DOCUMENTS

| | | | |
|---|---|---|---|
| Re. 30,958 | 6/1982 | White | 40/310 |
| 1,581,170 | 4/1926 | Burdell | 283/81 |
| 2,248,317 | 7/1941 | Van Cleef | 206/447 |
| 3,233,918 | 2/1966 | Tathwell | 282/9 R |
| 3,272,532 | 9/1966 | Owen | 282/22 R |
| 3,312,005 | 4/1967 | McElroy | 40/638 |
| 3,332,829 | 7/1967 | Avery | 428/40 |
| 3,383,121 | 5/1968 | Singer | 282/12 R |
| 3,596,388 | 8/1971 | Shorten | 40/657 |
| 3,820,261 | 6/1974 | Beall, Jr. | 40/2 |
| 3,981,523 | 9/1976 | Maalouf | 282/28 R |
| 3,987,960 | 10/1976 | Gardiner | 229/74 |
| 4,128,954 | 12/1978 | White | 40/310 |
| 4,178,018 | 12/1979 | Halse | 282/11.5 A |
| 4,199,174 | 4/1980 | Sornberger | 282/27.5 |
| 4,277,089 | 7/1981 | Lockhart | 282/27 R |
| 4,493,496 | 1/1985 | Kaluza | 282/9 R |
| 4,583,765 | 4/1986 | Messinger | 282/9 R |
| 4,614,361 | 9/1986 | Foster | 282/8 R |
| 4,674,771 | 6/1987 | Thompson | 282/8 R |
| 4,714,276 | 12/1987 | Greig | 283/66 A |
| 4,720,479 | 1/1988 | Craig et al. | 503/200 |
| 4,798,401 | 1/1989 | Greig | 282/9 R |

FOREIGN PATENT DOCUMENTS

| | | | |
|---|---|---|---|
| 1010472 | 5/1977 | Canada | 282/11.5 A |

*Primary Examiner*—Paul A. Bell
*Assistant Examiner*—Yu-Chi Lin
*Attorney, Agent, or Firm*—Nixon & Vanderhye

[57] ABSTRACT

Business form assemblies are provided in continuous form, separated by transverse lines of perforations, each of said assemblies including a three-part form. In one embodiment, the intermediate and lowermost form parts include repositionable labels carried by carrier plies, and carbon transfer sheets are interleaved between the upper form part and the intermediate label, and between the intermediate carrier play and the lower label. In another embodiment, the carbon transfer sheets are eliminated and replaced by a carbonless transfer system including adjacent coatings of microcarbon capsules and carbonless resin coatings. In still another embodiment, three self stick, repositionable labels are provided wherein the upper and intermediate labels are carried by tissue plies and the lower label is carried by a conventional paper ply.

7 Claims, 2 Drawing Sheets

FIG. 1
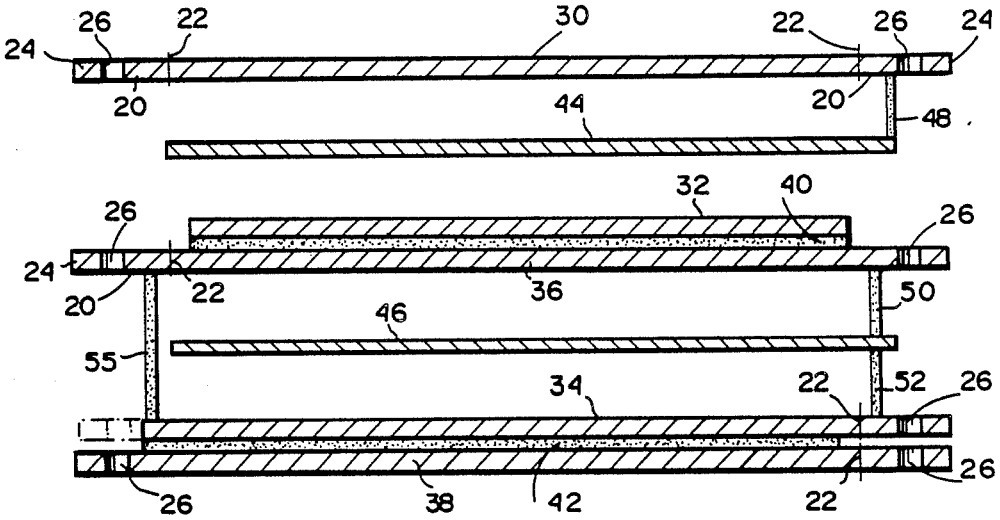
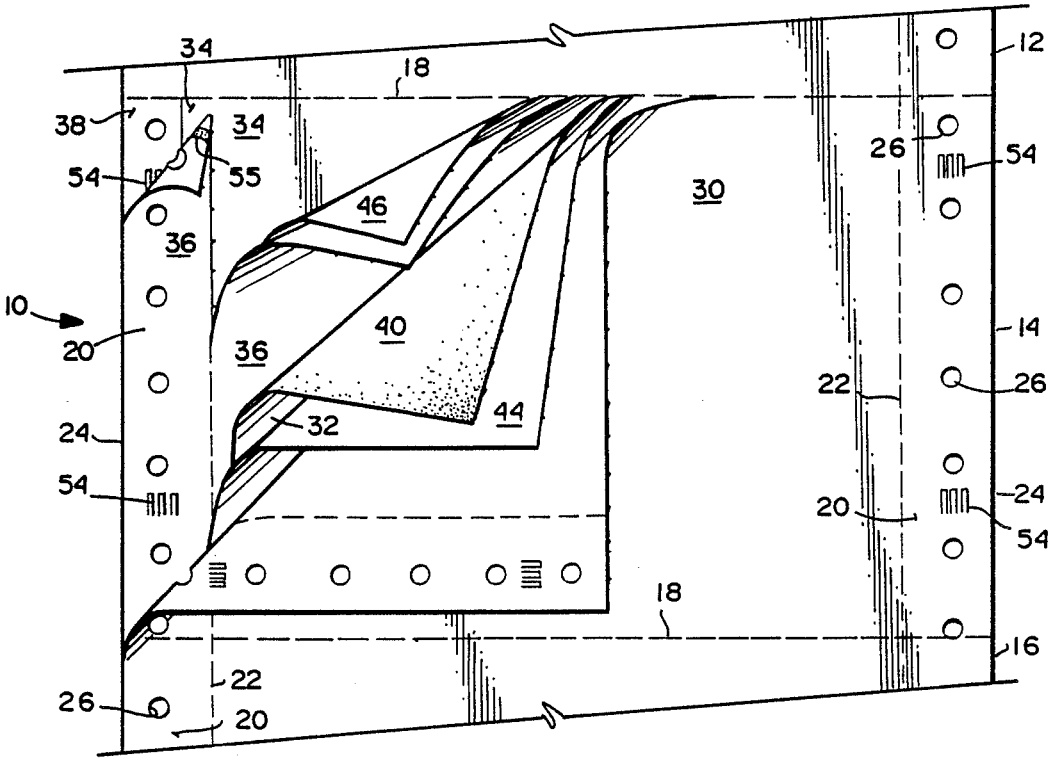
FIG. 2

BUSINESS FORM WITH REPOSITIONABLE LABELS

BACKGROUND AND SUMMARY OF THE INVENTION

This invention relates generally to business forms and, specifically, to a multiple part business form assembly with repositionable self-stick adhesive labels as one or more of the form parts.

It is often necessary to individually identify packages or other items to be mailed, shipped, etc., by, for example, the name and address of a purchaser and/or a related invoice number or the like. Other required information may include the sender's name and address as well as information specific to the item being shipped. Similarly, accurate identification and recording of information is essential many other areas, for example, in the medical field, and particularly for laboratory specimens, etc.

It has been the practice to write or otherwise transfer information onto envelopes, packages or other items for identification purposes. Typically, such information is taken from other documents which are related in some capacity to the shipment, e.g., a purchaser list, inventory list, laboratory sample, etc. This procedure, of course, is open to the possibility of erroneous transfer, and an overall lack of procedural uniformity. This same problem exists in the medical, pharmaceutical, mail order and other areas where accurate transfer of information is essential. The use of carbon transfers is acceptable for some applications, but since transfer sheets are not adhesive in nature, they are prone to being torn, lost or misplaced. This is particularly true since the individual sheets of a form assembly must be torn away from the form carefully, and thereafter, some additional means must be employed to affix the sheet or sheets to other surfaces.

Self-stick labels have been used to mark or tag packages, laboratory samples, and the like and, to some extent, lessen the time and effort involved in tagging the items. Nevertheless, there remains the problem of how to minimize the information transfer process, particularly where multiple labels are required.

This invention solves these problems by incorporating self-sticking, repositionable labels into a business form assembly so that information originally recorded on a form part or the like, is simultaneously recorded on one or more labels temporarily adhered to one or more carrier sheets or plies which are also part of the assembly. In this way, the labels may thereafter be quickly and easily removed from the form assembly and reused as desired.

Generally, the business form assembly of this invention comprises a multi-part form, preferably manufactured in continuous web form wherein individual form sets or assemblies are separated by transverse lines of perforations, spaced longitudinally along the web. At least one, and as many as all of the form parts includes a self-stick, repositionable label. Such labels, wherein one side is provided with a full surface coating of light-tack adhesive, are themselves not new to this invention. One preferred adhesive is that produced by Moore Business Forms, Inc., identified as NOTE STIX TM adhesive, but other light-tack repositionable adhesives may also be used. In this invention, labels of the aforementioned type are incorporated into business form constructions having alternative transfer media to produce a versatile form assembly with numerous benefits and advantages as compared to prior art forms.

In one exemplary embodiment, the form assembly comprises a three-part form, two parts of which comprise self-sticking and repositionable labels carried by paper plies.

Specifically, this first embodiment includes an upper, plain paper ply constituting a first form part, an intermediate carrier ply and a lower carrier ply, each of the last two mentioned plies carrying self-sticking, repositionable labels constituting second and third form parts, respectively. Interleaved between the form parts are thin carbon sheets which allow information applied to the upper ply to be simultaneously transferred to both labels.

In this first embodiment, individual form sets or assemblies are preferably formed within a continuous web, and defined by longitudinally spaced, transverse lines of perforations. At the same time, longitudinal lines of perforations may be provided in at least one of the form parts, preferably the upper form part, in proximity to the edges of the web, thereby defining removable marginal feed strips on either side of the web. Conventional tractor drive feed holes may be provided within marginal strips in longitudinally spaced relationship.

Longitudinal lines of adhesive may be provided inside the marginal feed areas for securing the thin carbon transfer sheets to the form parts immediately above and/or below. In addition, a longitudinal adhesive strip may be applied between the intermediate and lower form parts inside the line of feed holes. However, no other adhesive is required in the marginal areas connecting the upper ply to the intermediate ply, or the intermediate ply to the lower ply. Rather, mechanical crimps or "paper staples" longitudinally spaced within the marginal feed strip areas, are sufficient to maintain the integrity of the form assembly.

The self-sticking, repositionable label associated with the second form part does not extend into the marginal feed areas, but terminates short of each of the longitudinal lines of perforations.

The self-sticking repositionable label carried by the third form part may or may not extend on one or both sides into the marginal feed strip areas, but preferably, self-stick adhesive is substantially excluded from any part or parts of the label which do extend into the marginal feed areas.

In an alternative embodiment, the carbon transfer sheets are eliminated and replaced by a carbonless transfer system. In this second, exemplary embodiment, the underside or back of the upper, paper ply is coated inside the marginal areas with carbonless, rupturable microcapsules. This is referred to as an MCP-CB coating (microcapsule-coated back), and the upper or front surface of the self-stick repositionable label carried by the intermediate ply is provided with a carbonless resin coating of color-forming reactive material. This is referred to as a CF coating (coated front).

At the same time, the underside or back of the intermediate ply is provided with an MCP-CB coating inside the marginal areas, and the upper surface of the lower self-stick label carried by the lower carrier ply is provided inside the marginal areas with a CF coating.

The carbonless transfer system described hereinabove and the manner in which images are transferred in such systems is disclosed in detail in U.S. Pat. No.

4,199,174, which disclosure is incorporated herein by reference.

The remainder of the form assembly in this second exemplary embodiment is generally similar to that of the first embodiment.

In still another exemplary embodiment of the invention, the upper or first form part comprises a self-sticking, repositionable label carried on an MCP-CB tissue, i.e., a translucent material commonly used in the making of carbon transfer sheets, coated with a carbonless microcapsule coating on its underside. Such tissue is generally of considerably less thickness than conventional opaque paper sheets used as label carriers in the previously described embodiments.

The second form part in this third exemplary embodiment comprises a second self-sticking, repositionable label provided on its upper or front side with a CF coating. This second form part is carried by a second, or intermediate, tissue ply. This intermediate tissue ply is also provided with a carbonless microcapsule coating on its underside or back, and is therefore also referred to as an MCP-CB tissue.

The third form part comprises a self-sticking label ply provided with a CF coating on its upper or front side, and carried by a conventional release liner ply, i.e., a paper ply coated with a release composition.

The remainder of the form assembly construction is similar to the first and second described embodiments, insofar as its incorporation into a continuous web, marginal feed strips and interconnection of form parts within a set or assembly are concerned.

While the above embodiments have been described as having three form parts superimposed one on the other, it will be appreciated that fewer or more than three parts may be incorporated into the form assembly.

It will therefore be appreciated that the present invention effectively incorporates self-sticking, repositionable labels into multi-part business forms so that information may be accurately transferred onto the labels simultaneously with application of the information to the form assembly as a whole. Thereafter, the labels may be peeled quickly and easily from the form assembly and used and re-used as desired. In addition, this unique incorporation of self-stick labels into business form sets can occur whether conventional carbon transfer or newer carbonless transfer systems are used. The result is a business form assembly with heretofore unachieved flexibility and versatility which has application in a great many fields where accurate information transferability and traceability are required.

Other objects and advantages will become apparent from the detailed description which follows.

BRIEF DESCRIPTION OF THE DRAWINGS

FIG. 1 is a cross-sectional view of a business form assembly in accordance with one exemplary embodiment of the invention;

FIG. 2 is a partial plan view of the assembly shown in FIG. 1, with edges peeled back;

DETAILED DESCRIPTION OF THE DRAWINGS

Figure 3:
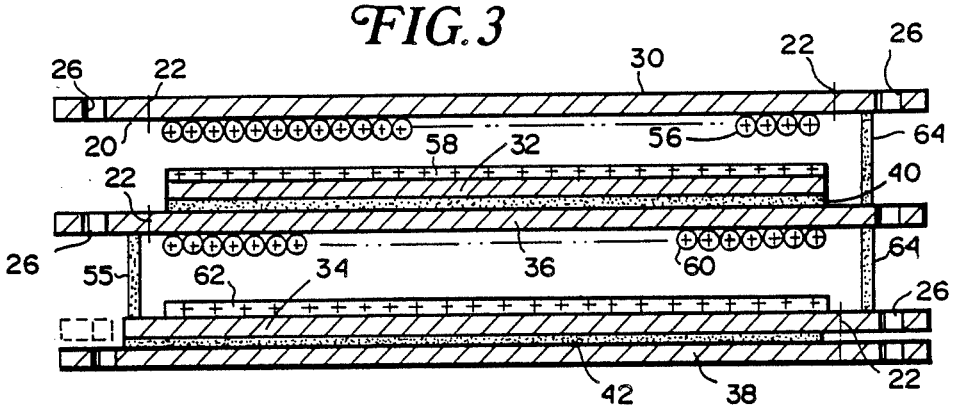
FIG. 3 is a cross-sectional view of a business form assembly in accordance with another exemplary embodiment of the invention.

With reference now to FIGS. 1 and 2, a multi-part business form assembly is shown in a preferred arrangement, as part of a longitudinally oriented, continuous web 10 which includes individual form sets 12, 14 and 16 separated by transverse lines of perforations 18. The continuous web is formed with longitudinally extending marginal feed strips 20 on either side thereof, some of which are defined by a longitudinally extending line of perforations 22, and a lateral edge 24. Whether or not the marginal feed are on either side of the form parts are removable, i.e., defined by a longitudinally extending perforation lines, depends to a large extent on the construction and intended use of the form part per se, as will be discussed further below. Within the marginal feed strips, there are located a plurality of longitudinally spaced feed holes 26 which are adapted to be engaged by conventional tractor drive devices utilized in business forms printing presses.

Each of the individual form sets, in this first exemplary embodiment, comprises a three part form including an upper, plain paper ply 30 comprising a first form part, a self-stick, repositionable label 32 comprising a second form part, and a self-stick repositionable label 34 comprising a third form part. The labels 32, 34 are carried by intermediate and lower paper plies 36, 38, respectively. As will be appreciated by those skilled in the art, the label 32 is provided with a full surface coat of light-tack adhesive 40 on its underside, while label 34 is provided with a similar full surface coat of light-tack adhesive 42 on its underside. The light tack adhesive allows the labels to be easily peeled from the carrier plies 36, 38 and thereafter adhered and removed from other surfaces as desired.

As best seen in FIG. 1, the self-stick label 32 carried by the intermediate ply 36, does not extend into the marginal feed strip areas 20 of the form set. However, the lower label 34 carried by the lower ply 38, does extend into the marginal area on the right hand side of the web. It may also extend into the left hand marginal area, as is shown in phantom. However, it will be seen that the full surface coating of light-tack adhesive 42 on the underside of label 34 does not extend the full width of the label, but rather, is confined substantially within the area between the marginal feed strips, although on the left hand side of FIG. 1, the adhesive coating 42 is shown to extend slightly into the marginal area but terminates approximately at the inside edge of the marginal feed holes 26.

It should be noted that the upper form part 30, intermediate carrier ply 36 and lower carrier ply 38 need not have removable marginal feed strips on either side thereof. In other words, how each form part is constructed and used will determine whether one or both marginal feed strips will include a longitudinal lines of perforations, thus rendering the strip or strips removable. For example, the upper form part 30 is shown to include removable marginal feed strips 20 on either side of the form assembly. Removal of the marginal feed strips is desirable primarily for aesthetic reasons. On the other hand, since the repositionable label 32 does not extend into the marginal feed areas, it is not important that intermediate carrier ply 36 have marginal feed strips which are removable, although they may be if so desired. The same is true with respect to the lower form part, recognizing that where label 34 extends into the marginal feed strip 20 on the right hand side of the web (FIG. 1), a line of perforations 20 is provided to facilitate removal of the marginal strips.

Interleaved between the upper form part 30 and label 32, and between intermediate ply 36 and label 34, are thin carbon transfer sheets 44, 46, respectively. The carbon transfer sheet 44 is secured to the underside of paper ply 30 immediately above by a longitudinally extending line of adhesive 48. Similarly, the carbon transfer sheet 46 is secured to the underside of intermediate carrier ply 36 by a longitudinally extending line of adhesive 50. A longitudinally extending line of adhesive 52 may be provided between the carbon transfer sheet 46 and the top surface of the label 34 carried by the lower carrier ply 38.

An additional longitudinal line of adhesive 55 extends between the underside of the intermediate ply 36 and the top side of the lower label 34 in an area between the feed holes 26 and longitudinal perforation lines 22 as best seen on the left hand side of FIG. 1.

It will therefore be seen that the present invention features minimum use of longitudinally extending adhesive lines for the purpose of holding the various form parts together. Paper staples 54, which, per se, are well known in the art, may be formed in longitudinally spaced relationship along the marginal feed strips 20 to assist in holding the various plies together and in proper superimposed relationship. At the same time, the paper staples facilitate easy separation of the form parts as required.

By the above described arrangement, information applied to the upper ply 30 is transferred onto the intermediate form part, i.e., label 32 and lower form part, i.e., label 34.

In one example of how the above described form may be used, after the first form part 30 (which may comprise a record or audit copy) and attached carbon transfer sheet 44 are removed, the lower carrier ply 38 may be peeled from the form and thereafter, the resulting two-part form consisting of labels 32, 34, intermediate carrier ply 36 and carbon transfer sheet 46 may be applied to, for example, a carton or other package containing a T.V., radio, or other item by means of the full surface coating of light-tack adhesive on the underside of the label 34. Later, when the item is removed from the carton, label 32, carrier ply 36 and carbon transfer sheet 46 may be "snapped off" the carton, leaving the label 34 attached thereto. Subsequently, carrier ply 36 may be peeled from label 32 along with the carbon transfer sheet 46 and discarded. The label 32 may then be affixed to the item via the adhesive on the underside thereof. This provides an information label that can be easily removed later, if necessary, by the consumer. If the item is subsequently returned in the carton, the label that remained on the carton is, of course, matched to the label on the item for ease of identifications, etc.

It will, of course, be understood that any number of attachment and reattachment sequences may be devised for the form assembly, depending on the particular use, e.g., shipping, medical, pharmaceutical, mail order, general inventory, etc.

With reference now to FIG. 3, a second exemplary embodiment is described which eliminates the need for carbon transfer sheets 44, 46. In plan, the construction for the assembly is similar to that shown in FIG. 2, with transfer sheets 44, 46 removed. In this second embodiment, the underside or back of the upper paper ply 30 comprising the first form part is coated inside the marginal feed areas with an MCP-CB coating 56 as described above, i.e., a coating of carbonless microcapsules as described in U.S. Pat. No. 4,199,174. The upper, or front surface of the self-stick repositionable label 32 carried by the intermediate ply 36 is provided with a CF coating 58.

In addition, the underside, or back of the intermediate carrier ply 36 is also provided with an MCP-CB coating 60 inside the marginal areas. The upper surface of the lower self-stick label 34, carried by the lower carrier ply 38, is provided inside the marginal areas with a CF coating 62.

In this manner, information applied to the upper form part 30 is transferred onto labels 32, 34, in the manner more fully described in U.S. Pat. No. 4,199,174.

In the absence of carbon transfer sheets 44, 46, additional, vertically aligned (or slightly offset) longitudinal lines of adhesive 64 may be employed between the upper ply 30 and intermediate carrier ply 36, and between the intermediate carrier ply 36 and the lower label 34. These adhesive lines are located inside the marginal feed holes 26 but outside the longitudinal perforation lines 22.

Otherwise, the form assembly of FIG. 3 is substantially identical in construction to the form assembly illustrated in FIG. 1.

It will be appreciated that the form assembly illustrated in FIG. 3 may be used as described above in connection with the use of the form shown in FIG. 1, or it may be used in many other ways, as will be appreciated by those skilled in the art.

Figure 4:
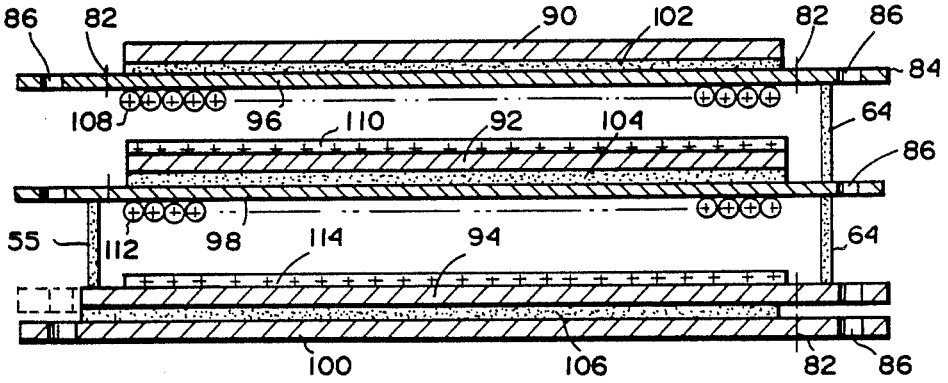
FIG. 4 is a cross-sectional view of a business form assembly in accordance with still another exemplary embodiment of the invention.
Figure 5:
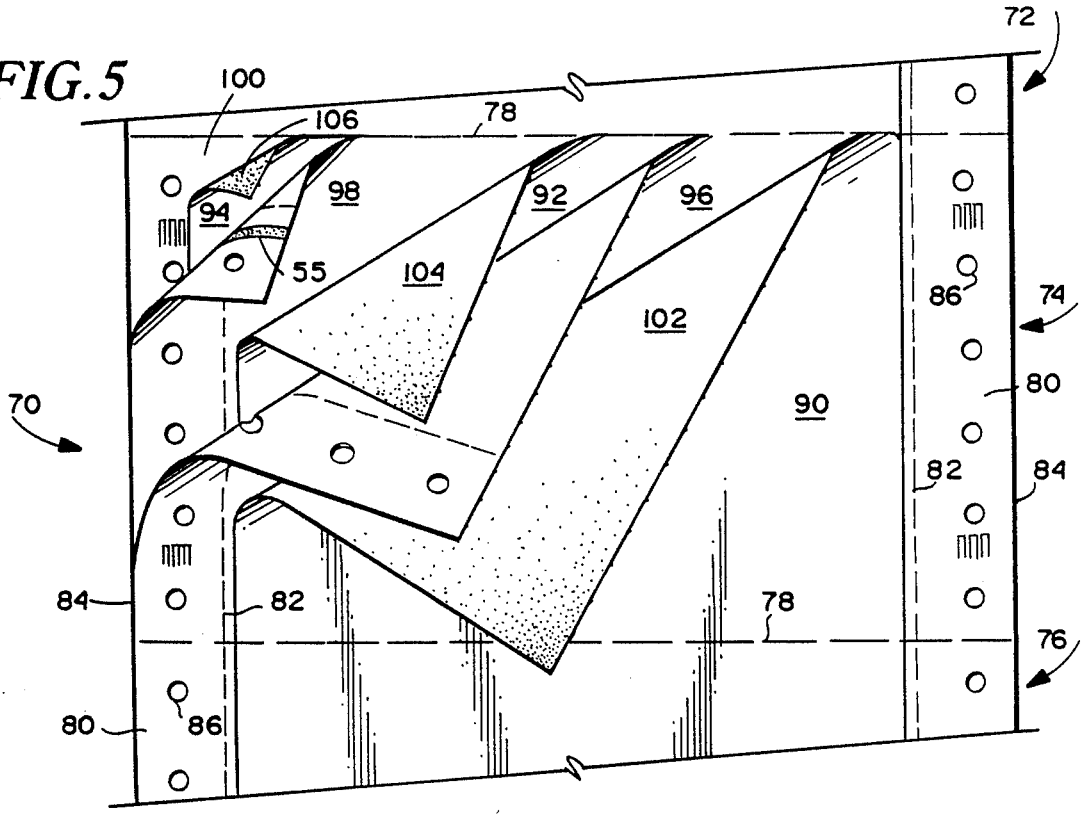
FIG. 5 is a partial plan view of the form assembly illustrated in FIG. 4, with edges peeled back.

In still another exemplary embodiment of the invention, illustrated in FIGS. 4 and 5, a three-part form set is provided which, as best seen in FIG. 5 is shown as part of a longitudinally oriented, continuous web 70, which includes individual form sets or assemblies 72, 74, 76 separated by transverse lines of perforations 78. The continuous web includes longitudinally extending marginal feed strips 80 on either side thereof, defined by longitudinally extending lines of perforation 82 spaced inwardly from the free edges 84 of the web. Each feed strip 80 is provided with feed holes 86 as in the previously described embodiments.

Each individual form set or assembly includes three repositionable labels 90, 92 and 94 as best seen in FIG. 4. The first, or upper, and second, or intermediate, labels 90 and 92 are carried by translucent tissue plies 96, 98, respectively. Typically, such tissue material is considerably thinner than the conventional opaque paper sheets used in the previously described embodiments, and, as already noted, is of the type usually used in the formation of carbon transfer sheets. Here, of course, no carbon material is applied to the tissues. The third label 94, is carried by an opaque paper carrier ply 100.

The labels 90, 92, 94 are provided on their undersides with full surface coatings of light-tack adhesive 102, 104, 106, respectively, so that the labels are easily removable from the tissue carrier plies 96, 98 and opaque paper carrier ply 100. The upper surface of carrier ply 100 may be provided with a conventional release coating to facilitate removal of the label 94, but it is not required. The information transfer system used in this third exemplary embodiment is a carbonless system similar to that employed in the embodiment shown in FIG. 3. Thus, the underside or back of the tissue play 96 is provided with an MCP-CB coating 108 which cooperates with a CF coating 110 applied to the upper or front surface of the intermediate label 92.

The underside of the carrier tissue 98 is provided with an MCP-CB coating 112 which also cooperates with a CF coating 114 provided on the upper or front surface of the lower label 94.

It will be understood that, rather than tissue carrier plies for the upper and intermediate label parts, all three carrier plies for the form assembly may comprise opaque paper carriers.

Information is thus transferred from the fist form part to the second and third form parts in the same manner as explained hereinabove.

Otherwise, the form construction illustrated in FIG. 4 is identical to that shown in FIG. 3, and may be used in the same or different manner as described above.

It will therefore be seen that the invention successfully incorporates self-stick, light-tack adhesive labels into business form assemblies in a manner which provides great flexibility and versatility in the practical user of such forms, and which assures accurate transfer of information onto labels which may be used and re-used as desired.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A continuous business form assembly comprising a plurality of form sets formed within a continuous, longitudinally extending web, each set separated from adjacent sets by longitudinally spaced, transversely extending lines of perforations, said assembly further comprising marginal feed strips extending longitudinally along either side of said web, and wherein each of said form sets comprises:

upper, intermediate and lower form parts in superimposed relationship, wherein said upper form part comprises a non-adhesive paper ply and at least said intermediate and lower parts comprise self-stick labels temporarily adhered to associated lower and intermediate carrier plies, respectively and wherein at least said upper form part and said lower and intermediate carrier plies extend into said marginal feed strip; and transfer means disposed between said upper and said intermediate form parts, and between said intermediate and said lower form parts for transferring information applied to said upper part, to said intermediate and lower form parts.

2. A continuous business form assembly as defined in claim 1 wherein said intermediate carrier ply comprises a translucent tissue material.

3. A continuous business form assembly as defined in claim 2 wherein said lower carrier ply comprises opaque paper.

4. A continuous business form assembly as defined in claim 1 wherein said lower carrier ply comprises opaque paper.

5. A continuous business form assembly as defined in claim 1 wherein said transfer means comprises a carbonless system.

6. A continuous business form assembly as defined in claim 1 wherein said transfer means comprises a carbonless system, and wherein said upper form part is provided on a lower surface with a first coating of pressure rupturable microcapsules; said intermediate form part is provided on an upper surface with a first coating of color-forming reactive material; said intermediate carrier ply is provided on a lower surface with a second coating of rupturable microcapsules; and said lower form part is provided on an upper surface with a second coating of color-forming reactive material.

7. A continuous business form assembly as defined in claim 6 wherein said self-stick labels are provided on lower surfaces thereof with a coating of light-tack adhesive.

* * * * *